United States Patent [19]

DeCorso

[11] Patent Number: 4,787,208

[45] Date of Patent: Nov. 29, 1988

[54] LOW-NOX, RICH-LEAN COMBUSTOR

[75] Inventor: Serafino M. DeCorso, Upper Providence Township, Delaware County, Pa.

[73] Assignee: Westinghouse Electric Corp., Pittsburgh, Pa.

[21] Appl. No.: 621,129

[22] Filed: Jun. 15, 1984

Related U.S. Application Data

[63] Continuation of Ser. No. 356,068, Mar. 8, 1982, abandoned.

[51] Int. Cl.[4] ..... F02E 1/00

[52] U.S. Cl. ..... 60/723; 60/732; 60/753

[58] Field of Search ..... 60/723, 732, 753, 39.32; 415/214

[56] References Cited

U.S. PATENT DOCUMENTS

| | | | |
|---|---|---|---|
| 2,059,523 | 11/1936 | Hepburn et al. . | |
| 2,564,497 | 8/1951 | Navias . | |
| 3,594,109 | 7/1971 | Penny | 60/753 |
| 3,846,979 | 11/1974 | Pfefferle | 60/723 |
| 3,886,735 | 6/1975 | Irwin | 60/753 |
| 3,918,255 | 11/1975 | Holden . | |
| 3,922,851 | 12/1975 | Irwin . | |
| 3,934,408 | 1/1976 | Irwin | 60/753 |
| 3,981,142 | 9/1976 | Irwin | 60/753 |
| 4,030,875 | 6/1977 | Grondahl | 60/753 |
| 4,087,963 | 5/1978 | Schirmer | 60/732 |
| 4,112,676 | 9/1978 | DeCorso . | |
| 4,205,524 | 6/1980 | Schirmer . | |
| 4,273,824 | 6/1981 | McComas et al. | 415/214 |
| 4,285,193 | 8/1981 | Shaw et al. | 60/732 |

OTHER PUBLICATIONS

Carlstrom, L. A. et al, "Improved Emissions Performance in Today's Combustion System", pp. 1-19.

Hazard, H. R. "$NO_x$ Emission from Experimental Compact Combustors", ASME 1972.

*Primary Examiner*—Carlton R. Croyle

*Assistant Examiner*—Timothy S. Thorpe

*Attorney, Agent, or Firm*—E. F. Possessky

[57] ABSTRACT

A low-$NO_x$ combustor is provided with a rich, primary burn zone and a lean, secondary burn zone. $NO_x$ formation is inhibited in the rich burn zone by an oxygen deficiency and in the lean burn zone by a low combustion reaction temperature.

7 Claims, 3 Drawing Sheets

LOW-NOX, RICH-LEAN COMBUSTOR

This application is a continuation of application Ser. No. 356,068, filed Mar. 8, 1982, now abandoned.

BACKGROUND OF THE INVENTION

The present invention relates to combustion turbines as may be employed in a variety of uses, such as industrial processes, electric power generation, or aircraft engines. More particularly, the present invention is directed to combustors employed in combustion turbines for heating motive gases which drive the turbine.

In general terms, a typical prior art combustion turbine comprises three sections: a compressor section, a combustor section, and a turbine section. Air drawn into the compressor section is compressed, increasing its temperature and density. The compressed air from the compressor section flows through the combustor section where the temperature of the air mass is further increased. From the combustor section the hot pressurized gases flow into the turbine section where the energy of the expanding gases is transformed into rotational motion of a turbine rotor.

A typical combustor section comprises a plurality of combustors arranged in an annular array about the circumference of the combustion turbine. In conventional combustor technology, pressurized gases flowing from the compressor section are heated by a diffusion flame in the combustor before passing to the turbine section. In the diffusion flame technique, fuel is sprayed into the upstream end of a combustor by means of a nozzle. The flame is maintained immediately downstream of the nozzle by strong aerodynamic recirculation. The lack of thorough mixing of the fuel results in pockets of high fuel concentration and correspondingly high combustion reaction temperatures. Because the reaction temperature is high, hot gases flowing from the combustion reaction must be diluted downstream by cool air so as to prevent damage to turbine components positioned downstream. In addition, the flame diffusion technique produces emissions with significant levels of undesirable chemical compounds, including $NO_x$.

$NO_x$ results from two basic mechanisms. Thermal $No_x$ is produced from the combination of nitrogen and oxygen in the fuel oxidizer (air) during and after the combustion process when the temperature level is sufficiently high to permit the overall reaction of $$N_2+O_2 \rightarrow 2NO$$

to occur at a measurable rate. The thermal $NO_x$ reaction occurs for all combustion processes using air and is essentially independent of the fuel.

$NO_x$ is also formed from fuel-bound nitrogen, which forms NO-type compounds in the combustion process in a manner somewhat analogous to the formation of CO and $CO_2$ from fuel carbon and $H_2O$ from fuel hydrogen. The differences between the two mechanisms for forming $NO_x$ lie in the time and temperature of the combustion process. Fuel-bound nitrogen compounds appear virtually simultaneously with the CO, $CO_2$, and $H_2O$, while the formation of $NO_x$ from the oxidizer appears later and is governed by a kinetic rate mechanism.

Increasing environmental awareness has resulted in more stringent emission standards for $NO_x$. The more stringent standards are leading to development of improved combustor technologies. One such improvement is a premixing, pre-vaporizing combustor. In this type of combustor, fuel is sprayed into a fuel preparation zone where it is thoroughly mixed to achieve a homogeneous concentration which is everywhere within definite limits of the mean concentration. Additionally, a certain amount of fuel is vaporized in the fuel preparation zone. Fuel combustion occurs at a point downstream from the fuel preparation zone. The substantially uniform fuel concentration achieved in the fuel preparation zone results in a uniform reaction temperature which may be limited to approximately 2000° to 3000° F. Due to the uniformity of the combustion, the pre-mixing, pre-vaporizing combustor produces lower levels of thermal $NO_x$ than does a conventional combustor using the same amount of fuel. $NO_x$ formed from fuel-bound nitrogen is tolerable because of the comparatively low nitrogen content of the typical petroleum fuel utilized.

The increased environmental awareness of recent years regarding emissions standards has been accompanied by a recognition of the limited availability of petroleum fuels. Consequently, a trend has developed focusing on the use of nonpetroleum fuels for combustion turbines. Nonpetroleum fuels typically have a higher nitrogen content than do petroleum fuels. For example, a typical petroleum fuel might have a nitrogen content of 0.1% by weight, while coal-derived liquids contain fuel-bound nitrogen up to 1% by weight and oil shale-derived liquid fuels contain fuel-bound nitrogen up to 2% by weight. Because they do not inhibit $NO_x$ formed from fuel-bound nitrogen, premixing, pre-vaporizing combustors would likely fail the stringent $NO_x$ standards when operated with nonpetroleum fuels.

Hence, it appears that known prior art combustors do not adequately provide for low-$NO_x$ emissions when operated with nonpetroleum fuels.

SUMMARY OF THE INVENTION

Accordingly, a combustion turbine combustor arranged to achieve low-$NO_x$ emissions comprises a basket, means for injecting fuel into the basket, means for providing fuel-rich combustion in a primary combustion zone, and means for providing fuel-lean combustion in a secondary combustion zone. The fuel-rich combustion disassociates fuel-bound nitrogen and inhibits the formation of $NO_x$ due to the oxygen-deficient atmosphere. The fuel-lean combustion, while completing the combustion process, is carried out at temperatures too low to enable the formation of thermal $NO_x$. Hence, stringent $NO_x$ emission standards may be adhered to when nonpetroleum as well as petroleum fuels are used to fuel the present combustor.

DESCRIPTION OF THE PREFERRED EMBODIMENT

Figure 1:
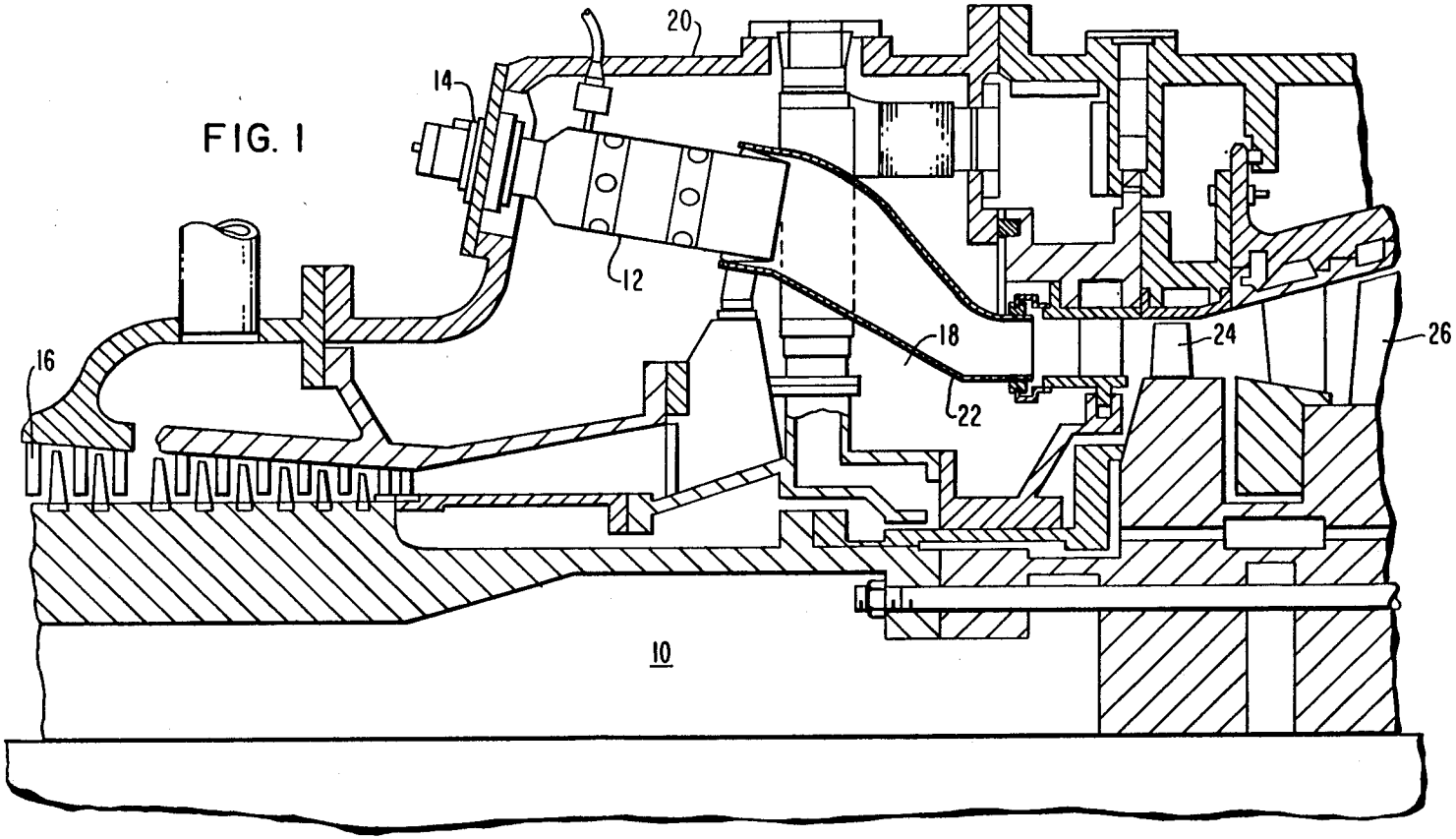
FIG. 1 shows a longitudinal section of a land-based combustion turbine arranged for the production of electric power; in particular, a combustor is depicted within the combustion turbine.

More particularly, there is shown in FIG. 1 a combustion turbine 10 having a plurality of generally cylindrical combustors 12. Fuel is supplied to the combustors 12 through a nozzle structure 14 and air is supplied to the combustors 12 by a compressor 16 through air flow space 18 within a combustion casing 20.

Hot gaseous products of combustion are directed from each combustor 12 through a transition duct 22 where they are discharged into the annular space through which turbine blades 24, 26 rotate under the driving force of the expanding gases.

Figure 2:
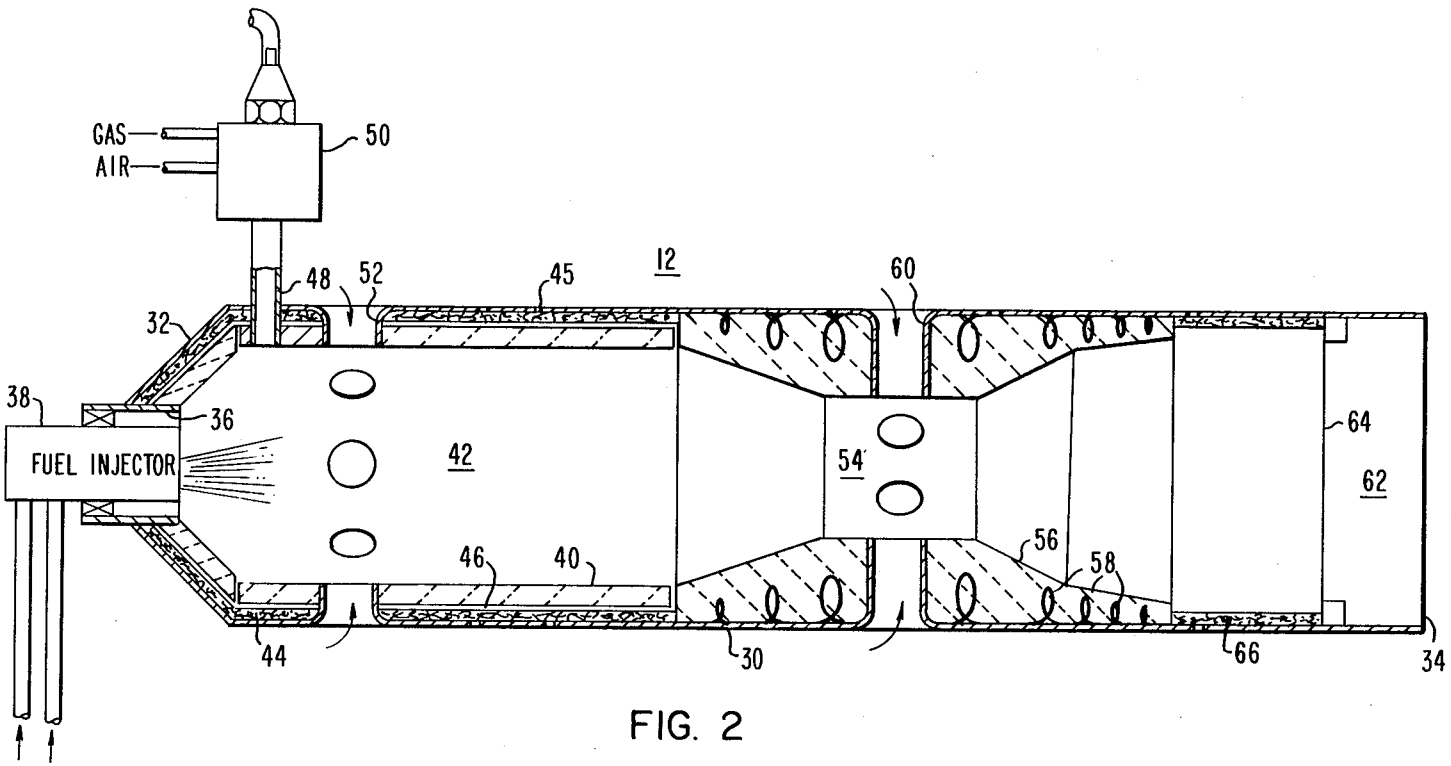
FIG. 2 shows a sectional view of the combustor shown in FIG. 1.

In accordance with the principles of the invention, combustor 12 is arranged to provide improved, low-$NO_x$ combustion emissions when operated with nonpetroleum fuels as well as with petroleum fuels. The combustor 12, shown in greater detail in FIG. 2, comprises a generally cylindrical outer metal jacket 30 having a conical-shaped upstream end 32 and being open-ended at the downstream end 34. The conical end 32 of the metal jacket defines a centrally positioned opening 36 having a pressure atomizing fuel injector 38, of a type well known in the art, protruding therethrough.

A ceramic cylinder 40, within the metal jacket 30, surrounds a rich burn zone 42 within the combustor 12. The ceramic cylinder 40 may comprise a monolithic cylinder or a cylinder formed from a plurality of sections. An expansion layer 44, comprising, for example, a network of wire mesh, separates the ceramic cylinder 40 from the metal jacket 30. The expansion layer 44 compensates for the different rates of thermal expansion of the ceramic cylinder 40 and the metal jacket 30. A plurality of bleed ports 45 in the metal jacket 30 provide a source of cooling air to the expansion layer 44. An insulating layer 46, comprised of suitable insulating material, separates the ceramic cylinder 40 from the expansion layer 44.

A flame tube 48 protrudes through the combustor wall (comprising at this point metal jacket 30, the expansion layer 44, the insulating layer 46, and the ceramic cylinder 40) at a point immediately downstream of the fuel injector 38. The flame tube 48 connects a torch igniter 50 to the rich burn zone 42, providing a hot flame jet for positive ignition of the combustor. Downstream of the flame tube 48, the combustor wall defines an annular ring of radially extending primary air ports 52 for delivery of an air supply for combustion in the rich burn zone 42.

A quench zone 54, downstream of the rich burn zone 42, comprises a Venturi-shaped section of the interior combustor wall. The combustor wall surrounding the quench zone 54 comprises the metal jacket 30 encasing cast ceramic 56. The cast ceramic, which is shaped to achieve the Venturi effect, is affixed to the metal jacket 30 by metal retainers 58 which are attached, such as by welding, to the metal jacket 30 and cast within the ceramic 56. The metal retainers 58 may be arranged in any fashion, such as the helical arrangement depicted in FIG. 2, which ensures the rigid attachment of the cast ceramic to the metal jacket 30.

The throat of the Venture-shaped combustor wall surrounding the quench zone 54 defines a plurality of annularly disposed cooling air ports 60 extending radially through the combustor wall (comprising this point the metal jacket 30 and the cast ceramic 56) for the delivery of cooling air to hot gaseous products produced in the primary burn zone 42.

A lean burn zone 62, positioned downstream of the quench zone 54, comprises a catalytic section 64 for secondary combustion of the gaseous products from the rich burn zone 42. The catalytic section 64 is surrounded by an expansion layer 66 of the same structure as the expansion layer 44 surrounding the rich burn zone 42. The expansion layer 66 is surrounded and contained by the metal jacket 30.

In operation, the atomizing fuel injector 38 sustains a diffusion flame in the fuel-rich atmosphere of the rich burn zone 42. Utilization of a diffusion flame for combustion of nonpetroleum liquid fuels has heretofore not been acceptable (according to known prior art) due to the problems associated with this technique. The ceramic cylinder 40 encasing the rich burn zone 42 eliminates the typical need for prior art film-cooling of the interior wall of the combustor. The lack of film cooling within the rich burn zone enables the success of fuel-rich combustion and actually enhances the combustion process by maintaining the walls at an elevated temperature.

The fuel equivalence ratio of a combustion zone is defined as the ratio of the actual fuel-to-air ratio to the stoichiometric fuel-to-air ratio. A lean combustion zone may have a fuel equivalence ratio as low as 0.4, while a rich combustion zone may operate at a value as high as 2.5. It is suggested that the rich burn zone of the present invention may operate favorably at a fuel equivalence ratio of 1.7.

Fuel-rich combustion provides an oxygen deficient atmosphere in which the relatively inactive fuel-bound nitrogen molecules, disassociated from the fuel by the combustion process, cannot compete with carbon and hydrogen for the limited oxygen molecules. Consequently, most of the nitrogen leaving the rich burn zone 42 is in the form of free nitrogen ($N_2$), rather than in the form of $NO_x$.

The hot gaseous products leaving the rich burn zone 42 are quickly diluted to a cooler temperature within the quench zone 54. The Venturi shape of the quench zone 54 promotes thorough and homogeneous mixing of the cooling air supplied to the ports 60 with the gaseous products from the rich burn zone.

The combustion process is completed in the lean burn zone 62, where the gaseous products from the rich burn zone 42, such as CO, smoke, and other unburned fuel components, are passed through the catalytic section 64. Combustion within the catalytic section 64 occurs at a temperature significantly reduced from the reaction temperature in the rich burn zone. The formation of thermal $NO_x$ is minimized by the lower lean combustion reaction temperature, which in essence limits the reaction rate of the formation of $NO_x$. Hence, the combustor 12 produces low-$NO_x$ emissions by disassociation the fuel-bound nitrogen in a rich combustion reaction in the rich burn zone 42 and completing the combustion process at temperatures too low for the formation of thermal $NO_x$. The formation of thermal $NO_x$ within the rich burn zone is inhibited by the deficiency of the oxygen molecules necessary for the reaction.

Figure 3:
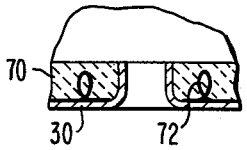
FIG. 3 shows an alternative embodiment of the wall of the combustor shown in FIG. 2.

FIG. 3 shows an alternative embodiment for the combustor wall surrounding the rich burn zone 42. This embodiment comprises a structure substantially similar to that of the combustor wall surrounding the quench zone 54. In the alternative embodiment, the rich burn zone is surrounded by a ceramic layer 70 cast to the metal jacket 30 and affixed to the metal jacket by metal retainers 72.

Figure 4:
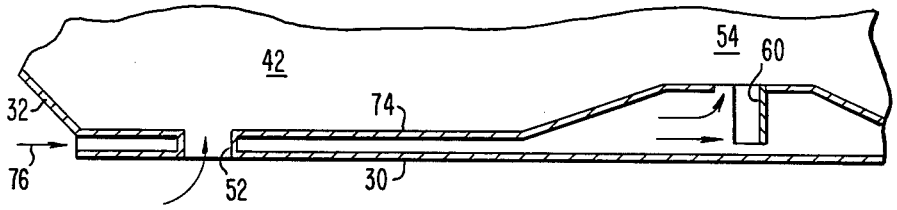
FIG. 4 shows a third embodiment of the wall of the combustor shown in FIG. 2.

FIG. 4 depicts an alternative embodiment for the wall of the combustor 12. This embodiment comprises the outer metal jacket 30 surrounding an inner metal jacket 74, the jackets 30, 74 extending from the dome 32 to the downstream end 34 of the combustor 12. Cooling air, depicted at 76, enters the space between the metal jackets 30, 74 at the upstream end of the rich burn zone 42. The cooling air circulates around the primary air supply ports 52 to reach the cooling air ports 60. In this embodiment, the cooling air which entered at 76 cools the inner metal jacket 74 along the rich burn zone and provides the sole source of cooling air used within the quench zone to dilute the temperature of the hot gaseous products leaving the rich burn zone. Some of the cooling air which entered at 76 is diverted to cool the inner metal jacket downstream of the cooling air ports 60.

Figure 5:
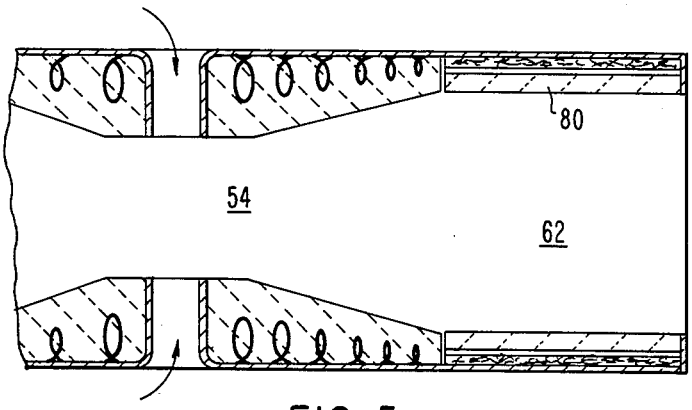
FIG. 5 shows an alternative embodiment of the downstream portion of the combustor shown in FIG. 2.

FIG. 5 depicts an alternative embodiment for the lean burn zone 62. In this embodiment, the lean burn zone comprises a straight cylindrical section, structured substantially similar to the rich burn zone 42 of FIG. 2, or the rich burn zone of FIG. 3. In this embodiment, lean combustion is accomplished at the lower temperatures of the gases within the lean burn zone, which temperatures are still high enough to ensure combustion. Further, the ceramic wall 80 surrounding the lean burn zone 62 enhances the secondary combustion process.

Hence, the present invention provides an efficient combustor for achieving low-$NO_x$ emission from the combustion of nonpetroleum as well as petroleum fuels. Combustion in a fuel-rich burn zone disassociates fuel-bound nitrogen in an oxygen-deficient atmosphere which inhibits the formation of thermal $NO_x$ and combustion is completed in a fuel-lean combustion zone at temperatures too low to allow the formation of thermal $NO_x$.

What is claimed is:

1. A low-$NO_x$ combustor for heating compressor discharge gases to drive a turbine, comprising:

a basket having a wall for containing combustion therein and further having an upstream zone for fuel rich, diffusion flame combustion and a downstream zone for fuel-lean combustion with a necked-down quench zone connecting said cumbustion zones;

means for injecting fuel into the upstream end of said basket;

means for enabling fuel-rich combustion of the fuel injected by said injecting means in said fuel-rich combustion zone;

means for introducing a quench air flow into said combustor quench zone to assure downstream fuel-lean combustion of gaseous products produced in said fuel-rich combustion zone without need for dilution air admission;

said basket wall having disposed about its inner side and along said rich zone a first ceramic enclosure means to support combustion without wall cooling air;

means for admitting oxidant to said rich zone including openings through said basket wall and said first ceramic enclosure means to ensure that the fuel equivalence ratio within said rich zone is greater than 1.0;

means for igniting the injected fuel;

a first section at the upstream end of said quench zone gradually decreasing in diameter in the downstream direction;

a second section at the downstream end of said quench zone gradually increasing in diameter in the downstream direction;

a third section between said first and second sections having a substantially constant inner diameter and a plurality of annularly disposed cooling ports extending radially therethrough for supplying cooling air to said quench zone; and a second ceramic enclosure substantially continuous with said first ceramic enclosure being disposed along the inner side of the first, second and third wall sections of said quench zone.

2. A combustor according to claim 1 wherein a second ceramic enclosure is disposed along the inner side of the first, second, and third wall sections of said quench zone.

3. A combustor according to claim 2 wherein said second ceramic enclosure comprises a cast ceramic member affixed to a metal jacket surrounding said second ceramic enclosure.

4. A combustor according to claim 1 wherein a catalytic element is disposed within said lean zone to support catalytic combustion therein.

5. A combustor according to claim 4 wherein said lean burn zone further comprises:

a metal jacket surrounding and enclosing said catalytic element; and an expansion layer between said metal jacket and said catalytic element, comprising a wire mesh material.

6. A combustor according to claim 1 wherein a third ceramic enclosure substantially continuous with said second ceramic enclosure being disposed along the inner side of the lean zone wall to support fuel-lean combustion of the gaseous products leaving the quench zone.

7. A combustor according to claim 6 wherein said third ceramic enclosure comprises ceramic cast and affixed to a metal jacket surrounding said third ceramic enclosure.

* * * * *